US006726960B1

(12) United States Patent
Sanduja et al.

(10) Patent No.: US 6,726,960 B1
(45) **Date of Patent: *Apr. 27, 2004**

(54) PROTECTIVE COATING ON STEEL PARTS

(75) Inventors: Mohan L. Sanduja, Flushing, NY (US); Carl Horowitz, Brooklyn, NY (US); Ella Mayslich, Brooklyn, NY (US); Paul Thottathil, New Hyde Park, NY (US)

(73) Assignee: National Crane Corporation, Waverly, NE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 1065 days.

(21) Appl. No.: 08/919,448

(22) Filed: Aug. 28, 1997

Related U.S. Application Data

(63) Continuation of application No. 08/363,925, filed on Dec. 27, 1994, now abandoned.

(51) Int. Cl.[7] ..... B66C 32/687

(52) U.S. Cl. ..... 427/388.2; 427/386; 428/461; 428/447; 212/299

(58) Field of Search ..... 428/461, 447; 212/266, 267, 299; 427/388.1, 388.2, 388.3, 388.5, 386

(56) References Cited

U.S. PATENT DOCUMENTS

| | | | | |
|---|---|---|---|---|
| 4,004,695 A | * | 1/1977 | Hockensmith et al. | 212/144 |
| 4,105,811 A | | 8/1978 | Horowitz et al. | 427/302 |
| 4,106,955 A | | 8/1978 | Horowitz et al. | 148/6 |
| 4,453,988 A | | 6/1984 | Slater et al. | 148/6.14 |
| 5,015,507 A | | 5/1991 | DesLauriers et al. | 427/385.5 |
| 5,043,226 A | | 8/1991 | Wiedeman et al. | 428/461 |

FOREIGN PATENT DOCUMENTS

| | | | |
|---|---|---|---|
| DE | 3803866 | * | 8/1989 |

OTHER PUBLICATIONS

Encyclopeda of Chemical Technology (fourth edition), Vol 6, pp 706–710, 1993.*

* cited by examiner

*Primary Examiner*—D. Lawrence Tarazano
(74) *Attorney, Agent, or Firm*—Birch, Stewart, Kolasch & Birch, LLP

(57) ABSTRACT

This invention relates to the coating of steel parts with organic polymeric materials for resistance to corrosion, abrasion, impact, salt solutions of high and low pH (both in liquid as well as vapor state) and corrosive atmospheric gases under the environment of high relative humidity and ambient conditions of temperature and pressure. To obtain secure and permanent adhesion of the coating on the steel article a polymeric coating is formulated so as to achieve chemical grafting to the steel face. This involves the use of monomers, prepolymers, catalyst and a graft initiator system. The monomers are preferably polyfunctional and when applied onto a metallic substrate, react via graft polymerization with the metal to form a polymerized layer coated onto the surface of the steel substrate. The monomers and prepolymers are so selected that when polymerized onto steel the coating has substantially zero moisture vapor-gas transmission rate and consequently acts as a barrier to moisture, oxygen and other gases from coming in contact with the surface of the steel substrate thereby improving the protective potential of the coating. Fillers may be included in the coating material to enhance physical or wear characteristics. Other components that can be added are slip agents, wetting agents, thixotropic promoters and adhesion promoters. This coating process is particularly advantageous for use with steel parts used in the manufacture of cranes

14 Claims, 1 Drawing Sheet

PROTECTIVE COATING ON STEEL PARTS

This application is a continuation of application Ser. No. 08/363,925 filed on Dec. 27, 1994, now abandoned.

BACKGROUND OF THE INVENTION

The present invention relates to a protective coating for steel parts used in the manufacture of cranes. It also relates to a method of grafting a protective coating onto metallic parts that not only protects the part from corrosion and other adverse effects of the environmental conditions of temperature, pressure, humidity, corrosive gases like hydrogen sulfide, carbon dioxide, sulfur dioxide but also imparts an excellent degree of abrasion resistance.

The current process for the production of steel parts used in the manufacture of cranes doesn't apply organic coatings on the finished products so as to protect them against corrosion, abrasion, impact, under environmental conditions of temperature, pressures, humidity, salt solutions of low and high pH and high concentration of corrosive gases like hydrogen sulfide, carbon dioxide, sulfur oxide and other gases. This is particularly true when the steel cranes are continuously used outdoors in the open air at ambient conditions of temperature and pressure, where they are being subjected to wear and tear and more importantly undergo corrosion. This may be due to the fact that water, water vapor or moisture readily dissolves a small amount of oxygen from the air in the solution and this, when condensed on the surface of the steel substrate, contributes to corrosion. For such a situation, the present instant invention relates to a process and composition for graft polymerizing a protective coating onto metallic substrate, so that the protection is sufficiently durable and is not readily removed from the metal as it undergoes abrasion and exposure to the environmental conditions during routine use.

Presently many different types of surface coatings are used in an effort to achieve the necessary requirements in terms of protection against corrosion and other properties. These include protective paints, yellow and clear chromatic coatings, and precious and non precious metal platings. Each of these methods have coat or performance deficiencies. Lack of surface resistivity to wear, abrasion, corrosion, impact, adhesion and durability resistance are all problems associated with these organic paints and coatings. The metal platings are generally expensive, and in some cases, are not tenacious enough for the abrasive environments of corrosion liquids and gases encountered by these steel products. As these coatings are applied at a minimal thickness and are physically rather than chemically bonded to the metallic substrate, they are susceptible to removal by normal abrasion when used in working conditions in outdoor environments. These platings are also susceptible to galvanic corrosion when contacting dissimilar metal surfaces. There is also a phenomena known as "fretting corrosion" which occurs with minimal mating pressures and is associated with metal migration/loss across the boundary area. In these cases, base metal corrosion occurs and environmental protection is lost. Also, in some instances, aesthetics are impacted due to surface contamination and discoloration. Therefore, the tenacity of these coatings is not sufficient for the requirements as warranted by the present invention. Even when the metallic parts are coated with expensive organic coatings, the coatings tend to be permeable to various corrosive gases and liquids so that the requisite degree of corrosion protection is not obtained. Because these coatings adhere to the substrate only through physical bonds, they can be readily dislodged from the metallic substrate over a short period of time as moisture, oxygen, chlorine, hydrogen sulfide and other corrosive gases permeate beneath the coated polymeric film. In view of this, there is a need for a coating that not only protects the metal from corrosion but also is abrasion resistant and is tenacious with a high degree of durability.

U.S. Pat. No. 5,015,507 to Des Lauriero describes a method of converting a rusted surface to a durable one by using a reducing agent which will function to reduce trivalent iron to divalent iron; an organic monomer which is capable of polymerization in the presence of the reducing agent on the surface; and a free radical initiator, which will polymerize the organic monomer to form the durable coating.

U.S. Pat. No. 4,453,988 to Slater discloses a method for coating a rusted metallic surface that uses a meth(acrylic) monomer; a peroxide curing system; and drying oil. Both these coating systems suffer from poor adhesion to the metal surface, since no method is described for directly bonding the film to the metal.

A number of inventions have been described previous to this instant invention which address the bonding problem through grafting of the film. For example, in U.S. Pat. No. 4,105,811 by Horowitz, hereby incorporated by reference, grafting technology is described to achieve a transparent, impervious protective coating on aluminum. In this case a peroxide and silver ion are present to initiate and catalyze graft polymerization of monomers and prepolymers which attach to the aluminum surface.

U.S. Pat. No. 5,043,226 to Wiedeman, hereby incorporated by reference, described a method of grafting a conductive, tenacious and protective coating on a metallic substrate such as steel, aluminum iron, platinum or silver. This method employed one or more polymerizable monomers having at least two functionalities, one or more graft initiators containing nickel ion and a reducing agent capable of reducing nickel ion to nickel metal.

U.S. Pat. No. 4,106,955 to Horowitz, hereby incorporated by reference, relates to the coating of steel articles wherein monomers containing hydroxyl, carbonyl, amine, glycidyl or azirdinyl groups react with steel surface to produce a corrosion and abrasion resistant surface.

The present invention employs a coating composition which differs from those used previously and provides superior corrosion and abrasion resistance to those previous compositions now cited. The instant invention is particularly advantageous for steel cranes which because of specific metallurgical considerations require a polymerizable/graftable species and initiator combination which is adapted to reaction with that specific surface. It is felt that this process, using the composition specified, will have general utility in a number of applications. In addition, the superior bonding achieved will confer improved corrosion and abrasion resistance in other applications as well.

CHEMICAL GRAFTING—BACKGROUND

Chemical grafting involves the activation of the substrate. Once the substrate has been activated, chains of monomers linked by carbon-carbon bonds grow on the substrate as whiskers. These whiskers impart new and desirable properties permanently imparted to the substrate without damaging any of the existing positive characteristics of these materials. Many materials, both naturally occurring and synthetic, posses hydrogens which are more reactive than the "bulk hydrogens", for example, the tertiary hydrogen in polypropylene (1) the amide hydrogen in proteins (2) and the hydroxyl hydrogen in polysaccharides (3).

(1)

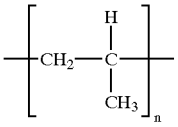

(2)

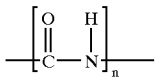

(3)

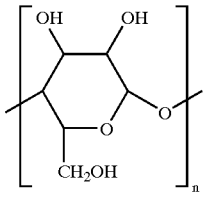

Graft initiators (G.I) have the capacity of removing these active hydrogens and concomitantly initiating the growth of polymer chains at the side from where the active hydrogen was removed.

In the case of polypropylene, this can be represented as follows:

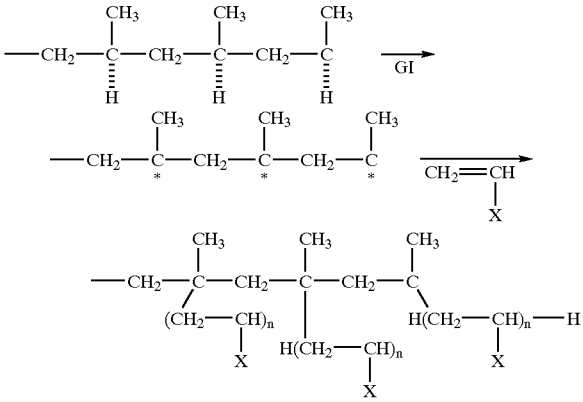

Where * can represent a free radical, anion or cation, depending on whether the G.I. removes a hydrogen and one electron, no electrons or two electrons respectively. (There are a wide variety of monomers which do not lend themselves to the free-radical type of polymerization. The use of all three mechanism broadens the scope of application of this method).

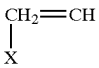

represents a unit of vinyl monomer where "X" governs the property or properties that are obtained. In many instances a mixture of monomers is employed and often more than one property can be altered in one processing step. These polymer chains whose length can be controlled, are permanently attached to the "substrate". The linkage between the graft-polymer and the substrate is covalent in nature, therefore, the graft-polymer cannot be leached from the substrate. In essence the chemical grafting consisted of growing polymer chains on the backbone chain of a substrate. The graft polymer chains are formed from vinyl monomers or monomer containing appropriate functionability, e.g., groups such as hydroxyl, carboxyl, epoxy, amide, amine anhydride.

Without being bound by any metal grafting theory, the details of which have not been fully established, the mechanism of reaction between the steel surface and monomers or prepolymers is thought to involve a reactive species on the steel surface. In the presence of moisture, there is a layer of oxide and hydroxyl groups tenaciously bound to the steel substrate. The hydrogen of the hydroxyl group may be removed by the graft initiator and form a radical which reacts with the monomer starting graft polymerization. The oxides and hydroxyl groups react with epoxy groups of the prepolymers or monomers starting a chemical reaction which also leads to a strong bonding between the steel and organic polymer formed on the surface.

Thus, the mechanism of graft polymerization may be presented in a series of steps as follows:

(1)

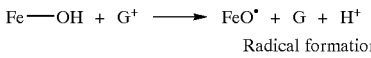

(2)

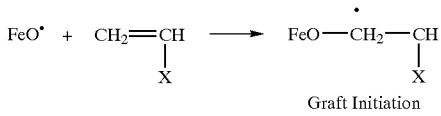

(3)

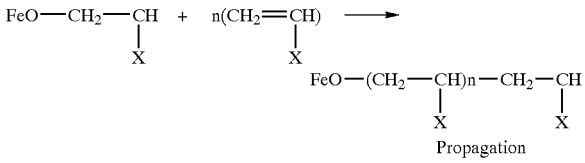

(4)

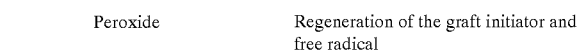

(5)

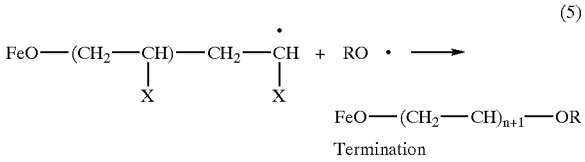

The process of termination may undergo differently when the formulation contain reactive prepolymers or polymers. The prepolymers may undergo also activation by the graft initiator giving reactive radicals P which react with the radical on the steel surface forming a graft coating on the substrate:

(6)

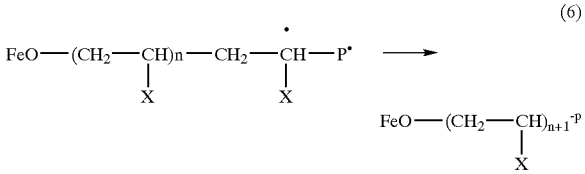

The graft initiator G may consist of the following metal ions; $Fe^{+++}/Fe^{++}$, $Ag^{+}$, $Co^{++}$, $Cu^{++}$and the peroxide should be chosen from catalysts such as benzoyl peroxide, methyl ethyl ketone peroxide, tert butyl hydroperoxide and hydrogen peroxide. The monomers and prepolymers have side functional groups x, which may react between themselves and with additional prepolymers or polymers included into the formulation forming a graft crosslinked organic coating. The functional groups of the monomers and prepolymers should consist of hydroxyl groups, carbonyl groups, secondary and/or tertiary amino groups and epoxy groups. The molecular ratio of the functional groups of the reactive components should be adjusted so that no free groups should be left after the reaction is finished.

SUMMARY OF INVENTION

It is accordingly a primary objective of the present invention to provide an improved process for the graft coating of steel surfaces with organic polymer material.

Another object of the invention is to provide organic materials which when coated onto the steel surface effect a graft coating, bonding the coating to the surface.

Yet another object of the invention is to provide steel workpieces, and especially crane parts having a coating of organic polymer material bonded permanently to the steel of the workpiece and adapted to resist corrosion and have desirable wear resistance and frictional characteristics.

A Still further object of the invention is to produce coated steel parts with substantially zero permeability to oxygen and other corrosive gases and with substantially zero water vapor transmission rates.

DESCRIPTION OF THE PREFERRED EMBODIMENT

Many metallic crane parts are subjected to adverse environmental and operating conditions. These includes salt solutions of high and low pH (both in liquid as well as vapor state), atmospheric gases like hydrogen sulfide, carbon dioxide, sulfur dioxide, and others under a perishable relative humidity >90% and ambient conditions of temperature and pressure. It has been found that by reactively coating the unfinished steel of the crane with a polymer which is chemically bonded to the surface of the steel that the coating is protective against corrosion and other adverse effects of the environmental conditions. It also imparts a high degree of abrasion resistance to the part, especially as used in crane applications.

Figure 1:
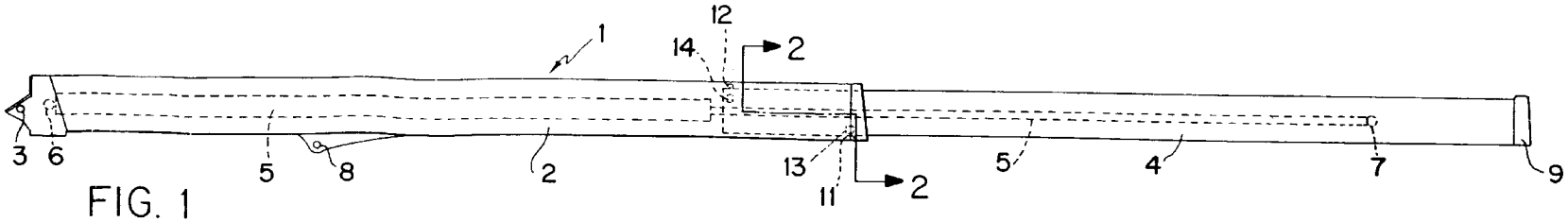
FIG. 1 is a schematic view of a two-section telescopic boom for a crane, aerial work platform, or the like, including the coating of the present invention, the boom being shown in an extended position.

Referring to the drawings in greater detail, by way of example of a structure on which the coating of the present invention has substantial utility, FIG. 1 shows a two-section telescopic boom 1 for a crane, mobile aerial work platform, or the like. While a two-section telescopic boom is shown, it is to be understand that the coating has utility in telescopic booms having three, four, or more sections, as well as in telescopically extendable and retractable outriggers, extendable lifting devices in fork lift trucks, and the like. The telescopic boom includes a base section 2 that is adapted to be pivotally connected at 3 at its innermost end to a superstructure (not shown), and an outer section 4 telescopically connected in base section 2 and extendable from and retractable into the base section by a hydraulic cylinder/piston assembly 5 having one end pivotally connected at 6 adjacent the innermost end of base section 2, and the outermost end of the piston rod pivotally connected at 7 adjacent the outermost end of outer section 4. A hydraulic lift cylinder (not shown) is adapted to be pivotally connected between the base section at 8 and the superstructure of the machine, for pivotally raising and lowering the telescopic boom about boom pivot connection 3, in the conventional and well known manner.

When the telescopic boom is used in a crane, a boom nose and lifting assembly is connected to the outermost end 9 of outer section 4, and when the telescopic boom is used in an aerial work platform, a work support platform is connected to the outer most end 9 of the boom.

Figure 3:
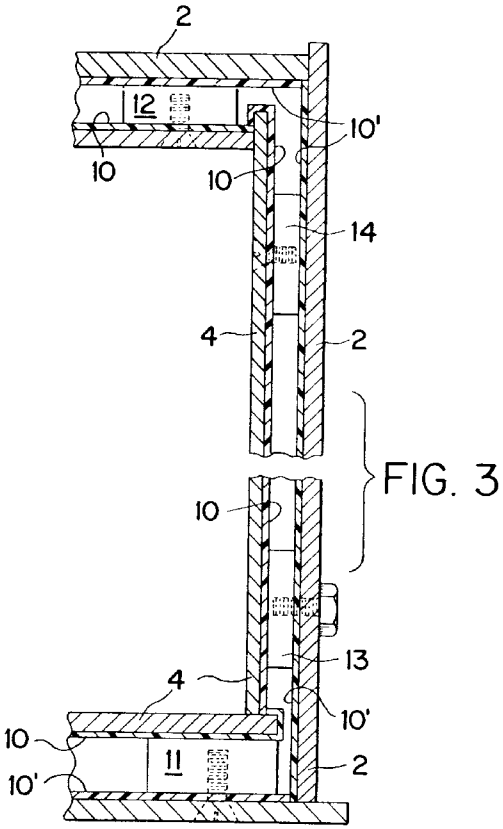
FIG. 3 is an enlarged fragmentary, cross-sectional view of the fragmentary portion labeled FIG. 3 in FIG. 2, and showing the coating of the present invention on the surfaces of the boom sections requiring lubrication and which are subject to sliding friction or abrasive forces.
Figure 2:
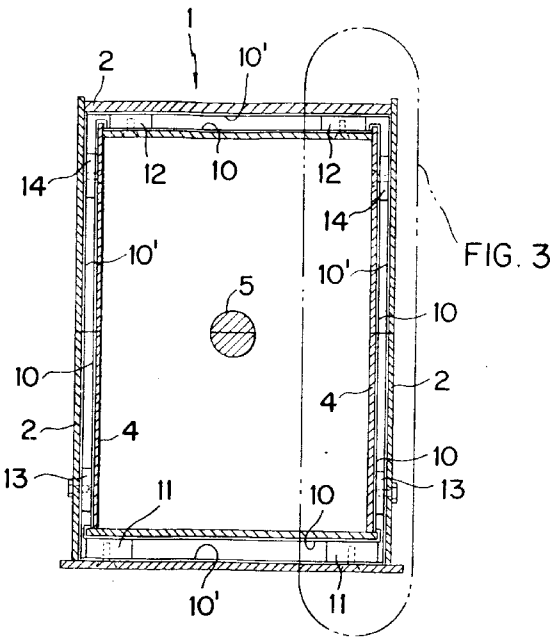
FIG. 2 is an enlarged cross-sectional view taken substantially along line 2—2 of FIG. 1.

As shown in FIGS. 2 and 3, the outside surfaces of outer boom section 4 is coated with the protective coating 10 of the invention, and the inside surface of boom base section 2 is shown coated at 10' with the protective coating of the present invention. These are the surfaces in a telescopic boom that are subject to sliding friction and abrasion forces, and which normally require application of lubrication compound. Bottom wear pads 11 are connected on the front of boom base section 2 in sliding contact with the bottom surface of outer boom section 4, and top wear pads 12 are connected on the top rear portion of outer boom section 4 in sliding contact with the top inner surface of boom base section 2. Front side wear pads 13, connected to the front side walls of boom base section 2, are in sliding contact with the outer side walls of outer boom section 4; and rear side wear pads 14, connected to the rear side walls of outer boom section 4, are in sliding contact with the inner side walls of boom base section 2. All of the wear pads 11, 12, 13 and 14 are conventionally constructed of Nylon material, know commercially as Nylatron. These wear pads may contain plugs of Teflon inserted therein for additional lubrication, but are not necessary for the present invention. The positions of the wear pads shown herein between the telescopic sections are for example only, and it is to be understood that the wear pads can be placed in other positions than those shown when used with the protective coating of the invention.

In the prior art, instead of the protective coating of the present invention shown at 10 and 10', paint has been used in the past. As the outermost boom section 4 is extended and retracted relative to boom base section 2 by the hydraulic cylinder/piston assembly 5, the wear pads 11, 12, 13 and 14 quickly wear off the prior art paint coating on the metal surfaces of the boom sections, resulting in the surfaces of the wear pads being in sliding contact with the bare metal surface of the respective boom sections. As the prior art paint coating wears off under the friction force of the wear pads, the paint coating galls and presents a rough sliding surface for the wear pads, which causes the outer boom section to chatter or jump as it is extended and retracted. To combat this, and to protect the bare metal surfaces of the boom sections against the elements, that is the metal surfaces left bare due to the paint coating being worn off, heavy lubricating compounds are applied to the bare metal surfaces, that is to the tracks on the surfaces against which the wear pads slide, left bare by the sliding friction movement therebetween. These lubricating compounds must be re-applied on a regular basis to prevent corrosion of the boom sections.

The protective coating of the present invention, shown at 10 and 10', is substituted for the prior art paint coatings, and, as shown in FIGS. 2 and 3, the surfaces of wear pads 11, 12, 13 and 14 are in sliding contact with the protective coating on the outside surface of outer boom section 4 and on the inside surface of boom base section 2. The protective coating of the present invention, over extended periods of use, shows no appreciable reduction in thickness of the coating layer in the area in sliding contact with the wear pads, does not gall, and provides sufficient lubricity so as to eliminate the need for application of lubricating compounds on the boom sections in the slide area of the wear pads, as required with prior art coatings. This eliminates the maintenance problem of dirt and contaminant build-up in the applied prior art lubricating compound, and provides a more aesthetic telescoping boom structure since the dark streaks of lubricating compound are eliminated from the boom sections.

While the protective coating of the present invention has been shown in the drawings at 10 and 10' applied only to the outer surface of the outermost boom section 4 and the inner surface of the boom base section 2, in practice the protective coating can also be applied to both the inner and outer surfaces of all boom sections, that is even those surface not requiring lubricity, and not normally subject to sliding frictional forces, because the anti-corrosive qualities of the protective coating protect all surfaces of the telescopic boom, as well as the metal surfaces on other assemblies and portions of the cranes, aerial work platforms, machines, and the like.

The present invention is based on covering the steel parts with a protective coating by chemically grafting organic monomers and prepolymers thereby forming a strongly bonded polymeric film to the steel surface. The monomers/prepolymers are so selected that the resulting polymeric film grafted onto the steel parts has substantially zero permeability to oxygen and other corrosive gases with substantially zero water vapor transmission rate, which allows it to improve the protective potential of the substrate. The polyfunctional monomers/prepolymers are vinyl monomers and epoxy prepolymers which are believed to be chemically bonded to the metal substrate via metal oxide. The monomers are preferably acrylic monomers having one or more hydroxy, carboxy and glycidyl groups.

Epoxy prepolymers and urethane prepolymers are particularly useful materials. The above prepolymers can be mixed with another monomer such as methyl methacrylate along with other ingredients in the graft polymerization process. Further monomers which can be included in the above formulations include monomers having functional groups such as hydroxyl, carboxyl, carbonyl, esters, amine, amide and glycidyl. The physical and chemical properties of the prepolymers and monomers included into the formulation have been chosen so that a high level of protective coating could be achieved.

Graft initiators like iron, silver, cobalt, copper, cerium, etc can be used as initiator ions in the graft polymerization process. However, the use of specific graft initiator ion depends on the nature of the substrate. In the graft polymerization reaction, the polymerization composition is comprised of polymerizable monomerstprepolymers, peroxide type catalyst and graft initiator system. The peroxide type catalyst is broken into active radicals by the action of the metallic silver. These radicals in turn initiate the polymerization of the monomer.

Further the abrasion resistance of the organic polymeric coating may be increased by incorporating inorganic fillers, such as calcium carbonate, titanium dioxide, mica, magnesium silicate, alumina, borax, iron oxide and silica.

In addition, slip agents such as molybdenum disulfide or fluorinated polymers may be used. Other slip agents that can be used include Super slip 6530 (a combination of wax polymers having a melting point of 255–275° F.), tungsten disulfide, Polymist F5A (micronized polytetrafluoroethylene powder), Polyfluoro 200 (a combination of polyethylene wax and polytetrafluoroethylene having a melting point of 255–259° F.) and Slip Ayd (dispersion of low molecular weight polyethylene or polymeric wax) Many other conventional additives may be found in the formulation including pigments, thixotropic promoters, lubricants slop agents, stabilizers, adhesion promoters, wetting agents, and anticorrosion agents.

In order to achieve good adhesion between the steel surface and the coating monomer it is advantageous to add other adhesion promoters. These can include organo silanes such as amino silanes, epoxy silanes, and vinyl silanes. Other adhesion promoters include, Silane A187 (gamma-glycidoxypropyltrimethoxy silane), Silane A110 (gamma-aminopropyltriethoxy silane) acrylate monomers, methacrylate monomers, titanates and zirconates.

The coating compositions of the present invention further include thixotropic agents such as, Cab-ol-sil TS720 (hydrophobic fumed silica), Cab-o-sil TS610 (fumed silica partially treated with dimethyldichlorosilane), Bentone 34 (hydrous magnesium aluminum silicate pigment suspending agent) and clay. Additionally, the coating compositions of the present invention include wetting agents such as Triton X-100 (alkylaryl polyether alcohol nonionic surfactant), Triton CF10 (alkylaryl polyether nonionic surfactant), Ssil-wet 77 (polyalkylene oxide modified dimethylpolysiloxane) FluorosurfactantFC430 (nonionic liquid fluorosurfactant), Modaflow (acrylate copolymer) and Witconol (surface wetting agent).

The concentration of the graft initiator i.e.,the silver salt can vary within a wide range such as 0.001% to 1% by weight of monomers. In general, the concentration can vary between 0.01% to 0.1% by weight of the monomers.

The concentration of the monomers/prepolymers in the solution can likewise vary within practically any limits, for example, between 0.1% to 50% of the formulation, though the preferred concentration is between 0.1% to 20%.

The concentration of the catalyst may vary in the range of 0.1% to 5% of the polymerization solution, though the preferred concentration is in the range of 0.05% to 1%.

The concentration of fillers used in the formulation vary in the range of 1 to 30% by weight of the formulation. However, the preferred concentration may vary in the range of 1 to 20% by weight.

Preferred examples of the process and coating composition in accordance with the invention are as follows:

EXAMPLE 1

| | PARTS BY WEIGHT |
|---|---|
| PART A | |
| Epoxy prepolymer Araldite GX 488 N-40 (a high molecular weight bisphenol A epoxy resin solution) | 100.00 |
| Fluoro polymer polymist F5A | 11.00 |

-continued

| | PARTS BY WEIGHT |
|---|---|
| Polyfluo 200 | 4.00 |
| Polysilk 14 | 4.00 |
| Tubular Alumina $A1_2O_3$ | 6.00 |
| Cab-o-sil TS 720 | 1.00 |
| Cab-o-sil TS 610 | 1.00 |
| Anticorrosive pigment shieldex | 1.00 |
| Mica C-3000 (micronized muscovite mica having an average particle size of 0.5 microns) | 10.00 |
| Methyl ethyl ketone | 76.00 |
| Dowanol PM (propylene glycolmethyl ether) | 15.00 |
| Xylene | 20.00 |
| Tungsten disulfide | 4.00 |
| Carbon black monarch 1400 | 5.00 |
| Molybdenum sulfide | 12.00 |
| Super slip 6530 | 1.00 |
| Monomer silane A 187 | 2.00 |
| Methyl methacrylate | 0.10 |
| PART B | |
| Urethane prepolymer Desmodur N-75 (aliphatic polyisocyanate resin based on hexamethylene diisocyanate and dissolved in n-butyl acetate and xylene) | 37.50 |
| Methyl ethyl ketone | 55.00 |
| Xylene | 30.00 |
| Celloslove acetate | 15.00 |
| Benzoyl peroxide 1% in MEK | 0.10 |
| Silver perchlorate 0.1% in MEK | 0.10 |
| PART C | |
| Catalyst Cycat 4040 (liquid para-toluene sulfonic acid catalyst) | 0.20 |

Mixtures (A) (B) and (C) were separately prepared. Mixture (A) except for silane A 187 and methyl methacrylate was mixed in a pebble mill for 48 hours. The contents were filtered and the monomer A187 and methyl methacrylate were added to the (A) admixture in the ratio indicated and mixed until uniform. Mixture (B) ingredients were added in the ratio and order as given in the composition and stirred thoroughly with a mixer to uniform solution. Mixtures (A) (B) and (C) were then added in the preparation 273:136:0.2 and then mixed for 10–15 seconds.

EXAMPLE 2

Steel crane pieces were prepared by cleaning with toluene followed by rinsing with methyl ethyl ketone and then the coating solution was applied by spraying onto the steel crane pieces or by dipping the pieces into the coating solution. The steel crane piece is cured at ambient temperatures for 24 hours. The pieces were tested for abrasion resistance by the qualitative falling sand method (ASTM method D-986-51). 25 liters of sand was made to fall on the coated coupon from a height of 4 ft. No chipping or peeling of the coating was observed. The adhesion was tested by a cross batch test, which is as follows: 10 parallel cuts, 1/16" apart were made through the film and 10 similar cuts were made at right angle (90) and crossing 10 cuts. Apply tape (3M transparent No.710, ¾" wide) over area of cuts by pressing down firmly against coating to eliminate voids and air pockets. Then sharply pulled tape off at right angle to the place of the surface being treated. No peeling off or removal of film was observed.

| | PARTS BY WEIGHT |
|---|---|
| PART A | |
| Epoxy prepolymer DER 684 EK40 (high molecular weight bisphenol A based epoxy resin) | 200.00 |
| Fluoro polymer polymist F5A | 22.00 |
| Polysilk 14 (soft wax polymer having a melting point of 205–245° F.) | 8.00 |
| Polyfluo 200 | 8.00 |
| Tubular Alumina $A1_2O_3$ | 12.00 |
| Cab-o-sil TS T20 | 2.00 |
| Cab-o-sil TS 610 | 2.00 |
| Anticorrosive pigment shieldex | 2.00 |
| Mica C-300 | 20.00 |
| Methyl ethyl ketone | 150.00 |
| Dowanol PM | 30.00 |
| Xylene | 40.00 |
| Tungsten disulfide | 8.00 |
| Carbon black | 10.00 |
| Molybdenum sulfide | 24.00 |
| Super slip 6530 | 2.00 |
| Monomer silane A 187 | 4.00 |
| Methyl methacrylate | 0.50 |
| PART B | |
| Urethane prepolymer Desmodur N-100 (aliphatic polyisocyanate based on hexamethylene diisocyanate) | 56.25 |
| Methyl ethyl ketone | 110.00 |
| Xylene | 78.00 |
| Celloslove acetate | 30.00 |
| Benzoyl peroxide 1% in MEK | 0.20 |
| Silver perchlorate 0.1% in MEK | 0.02 |
| PART C | |
| Catalyst Cycat 4040 | 0.40 |

Mixtures (A) (B) and (C) were prepared separately and mixed as outlined in Example 1, except the proportions for mixing were 273:137:0.2. The steel piece was coated and cured as in Example 1.

Steel coupons were coated with the formulation of example 2 by spraying or dipping. The coated samples were subjected to cure at room temperature (ambient) for 24–36 hours. However, the coated samples were also cured at 350° F. for 10–15 minutes. The coated samples were tested for abrasion and adhesion the same way as indicated in Example 1. The samples were also tested for corrosion resistance in 5% salt spray chamber maintained at 95° F. The samples were found to pass 500 hours of salt spray test.

EXAMPLE 3

| | PARTS BY WEIGHT |
|---|---|
| PART A | |
| Epoxy prepolymer Eponol 53 L 32 (high molecular linear copolymer of epichlorohydrin and bisphenol A) | 125.00 |
| Flouro polymer polymist F5A | 11.00 |
| Polyfluo 200 | 4.00 |
| Polysilk 14 | 4.00 |
| Tubular Alumina $A1_2O_3$ | 6.00 |
| Cab-o-sil TS 720 | 1.00 |
| Cab-o-sil TS 610 | 1.00 |
| Anticorrosive pigment shieldex | 1.50 |
| Mica C-3000 | 10.00 |
| Methyl ethyl ketone | 50.00 |
| Xylene | 16.00 |

-continued

| | PARTS BY WEIGHT |
|---|---|
| Dowanol PM | 20.00 |
| Tungsten disulfide | 4.00 |
| Carbon black | 5.00 |
| Molybdenum sulfide | 12.00 |
| Super slip 6530 | 1.00 |
| Monomer silane A 187 | 2.00 |
| Methyl methacrylate | 0.20 |
| PART B | |
| Urethane prepolymer Desmodur N-75 | 37.50 |
| Methyl ethyl ketone | 55.00 |
| Xylene | 30.00 |
| Celloslove acetate | 15.00 |
| Benzoyl peroxide 1% solution in MEK | 0.10 |
| Silver perchlorate 0.1% solution in MEK | 0.01 |
| PART C | |
| Catalyst Cycat 4040 | 0.20 |

Mixtures (A) (B) and (C) were prepared separately and mixed as outlined in Example 1, except the preparations for mixing were 273:137.5:0.2. Steel samples were coated and cured the same way as indicated in examples 1 and 2. Samples were found to pass 550 hours of salt spray test.

EXAMPLE 4

| | PARTS BY WEIGHT |
|---|---|
| PART A | |
| Epoxy prepolymer Araldite GZ488 N-40 | 100.00 |
| Flouro polymer polymist F5A | 8.00 |
| Polyfluo 200 | 7.00 |
| Polysilk 14 | 4.00 |
| Tubular Alumina $A1_2O_3$ | 6.00 |
| Cab-o-sil TS 720 | 1.00 |
| Cab-o-sil TS 610 | 1.00 |
| Anticorrosive pigment shieldex | 1.00 |
| Mica C-3000 | 10.00 |
| Methyl ethyl ketone | 76.00 |
| Dowanol PM | 15.00 |
| Xylene | 20.00 |
| Tungsten disulfide | 4.00 |
| Carbon black | 5.00 |
| Molybdenum sulfide | 12.00 |
| Super slip 6530 | 1.00 |
| Monomer silane A 187 | 2.00 |
| Monomer silane SR-350 | 0.50 |
| PART B | |
| Urethane prepolymer Desmodur N-100 | 28.12 |
| Methyl ethyl ketone | 55.00 |
| Xylene | 40.00 |
| Celloslove acetate | 15.00 |
| Benzoyl peroxide 1% in MEK | 0.10 |
| Silver perchlorate 0.1% in MEK | 0.01 |
| PART C | |
| Catalyst Cycat 4040 | 0.20 |

Mixtures (A) (B) and (C) were prepared separately and mixed as outlined in Example 1, except the preparations for mixing were 273: 137.5:0.2 and in mixture (A) monomer silane A187 and SR-350 were withheld in the initial mixing and then added to component (A) prior to mixing with component (B) and (C). The steel samples were prepared as well as tested the same way as in examples 1, 2 and 3. Crane steel parts treated in accordance with the process of this invention in which wear data (thickness of the coating) is taken at different time intervals over the period of use is presented in Table 1. No formal side by side comparison tests were made since the prior condition using various paint coatings, results in bare metal contact between the boom and the wear pads very quickly. Typically a lubricating compound is put on the booms in the wear pads areas from the start. All prior art coatings wear off so quickly that they have never made them a subject matter of a test. As can be seen in Table 1 with this inventive coating non appreciable thickness reduction occurs over the period of use.

Table 1 more specifically shows the results of 1,500 hrs of normal operating conditions of a telescopic boom crane, generally operating at approximately 5,000 lbs per square inch wear pad loading, with the boom sections moving at a velocity in the range of 1 foot to 2 feet per second. This chart shows that the protective coating of the invention provides a superior pressure/velocity tolerance over other coatings, typically paint type products, which normally gall during the first extension and retraction of the boom, and thereafter are worn off and expose generally bare metal after several extensions and retractions of the boom.

TABLE 1

FIELD TRIAL - UNIT 5/N 22054 (MODEL 656B)
PRCA/NCC Polymer Coating Formulation No. 11
Recorded Coating Thickness on Telescoping Boom

| Date | Measured Coating Thickness[1] | Operating Hours[2] |
|---|---|---|
| 6/21/93 | 1.8–2.4 mil - Avg 2.1 mil | 1039 |
| 4/29/94 | 1.4–2.0 mil - Avg 1.7 mil | 1537 |
| 8/28/94 | 1.2–2.0 mil - Avg 1.6 mil | 2539 |

[1]Coating film thickness on boom top and bottom plates as measured by Posi-Test mil gage.
[2]Crane operation hour meter.

We claim:

1. A process for providing a steel workpiece with a coating of organic polymeric material, which comprises the steps of:

(i) applying to an exposed face of the workpiece a composition comprising, (a) a polymerisable material having at least one constituent selected from each of epoxy prepolymers, and urethane prepolymers;

(b) a monomer or prepolymer having at least one active group adapted to form graft polymerization linkages with the steel and with the polymerizable material, selected from the group consisting of hydroxyl, carbonyl, carboxyl, esters of carboxyl, amino, and epoxy;

(c) a catalytic initiator selected from the group consisting of ions of iron, silver, cobalt and copper; and (d) a peroxide selected from the group consisting of benzoyl peroxide, methyl ethyl ketone peroxide, t-butyl hydroperoxide, and hydrogen peroxide; and (ii) curing the resulting workpiece.

2. The process claimed in claim 1 wherein the composition further includes inorganic filler.

3. The process claimed in claim 1 wherein the composition further includes a slip agent.

4. The process as claimed in claim 3, wherein the slip agent is selected from the group consisting of molybdenum disulfide, polytetrafluoroethylene and tungsten disulfide.

5. The process as claimed in claim 1 wherein the composition further includes wetting agents.

6. The process as claimed in claim 1 wherein the composition further includes thixotropic agent.

7. The process as claimed in claim 1, wherein the composition further comprises an adhesion promoter.

8. A coated steel workpiece coated by a process which comprises the steps of:

(i) applying to an exposed face of the workpiece a composition comprising, (a) a polymerisable material having at least one constituent selected from each of epoxy prepolymers, and urethane prepolymers;

(b) a monomer or prepolymer having at least one active group adapted to form graft polymerization linkages with the steel and with the polymerizable material, selected from the group consisting of hydroxyl, carboxyl, esters of carboxyl, amino, and epoxy;

(c) a catalytic initiator selected from the group consisting of ions of iron, silver, cobalt and copper; and (d) a peroxide selected from the group consisting of benzoyl peroxide, methyl ethyl ketone peroxide, t-butyl hydroperoxide, and hydrogen peroxide; and (ii) curing the resulting workpiece.

9. The coated steel workpiece of claim 8, wherein the composition further comprises (e) an inorganic filler selected from the group consisting of calcium carbonate, titanium dioxide, mica, magnesium silicate, alumina, borax, iron oxide and silica.

10. The coated steel workpiece of claim 9, wherein the polymerizable material (a) includes a vinyl monomer, and the monomer or prepolymer (b) has a trimethoxysilane group.

11. The coated steel workpiece of claim 8, wherein the polymerizable material (a) includes a vinyl monomer, and the monomer or prepolymer (b) has a trimethoxysilane group.

12. A telescopic boom for use in a crane coated with a composition comprising:

(a) a polymerisable material having at least one constituent selected from each of epoxy prepolymer, and urethane prepolymers;

(b) a monomer or prepolymer having at least one active group adapted to form graft polymerization linkages with the steel and with the polymerizable material, selected from the group consisting of hydroxyl, carbonyl, carboxy, esters of carboxyl, amino, and epoxy;

(c) a catalytic initiator selected from the group consisting of ions or iron, silver cobalt and copper;

(d) a peroxide selected from the group consisting of benzoyl peroxide, methyl ethyl ketone peroxide, t-butyl hydroperoxide, and hydrogen peroxide; and (e) an inorganic filler.

13. A telescopic structure for use in lifting equipment coated with a composition comprising:

(a) a polymerisable material having at least one constituent selected from each of epoxy prepolymer, and urethane prepolymers;

(b) a monomer or prepolymer having at least one active group adapted to form graft polymerization linkages with the steel and with the polymerizable material, selected from the group consisting of hydroxyl, carbonyl, carboxy, esters of carboxyl, amino, and epoxy;

(c) a catalytic initiator selected from the group consisting of ions or iron, silver cobalt and copper;

(d) a peroxide selected from the group consisting of benzoyl peroxide, methyl ethyl ketone peroxide, t-butyl hydroperoxide, and hydrogen peroxide; and (e) an inorganic filler.

14. A telescopic structure having at least one telescopic section extendable from and retractable into another telescopic section, and wear pads subject to high loading forces connected between and in sliding contact with surfaces of the respective telescopic sections, and at least the surfaces of the telescopic sections in sliding contact with the wear pads coated with a composition comprising:

(a) a polymerisable material having at least one constituent selected from each of epoxy prepolymer, and urethane prepolymers;

(b) a monomer or prepolymer having at least one active group adapted to form graft polymerization linkages with the steel and with the polymerizable material, selected from the group consisting of hydroxyl, carbonyl, carboxy, esters of carboxyl, amino, and epoxy;

(c) a catalytic initiator selected from the group consisting of ions or iron, silver cobalt and copper;

(d) a peroxide selected from the group consisting of benzoyl peroxide, methyl ethyl ketone peroxide, t-butyl hydroperoxide, and hydrogen peroxide; and (e) an inorganic filler.

* * * * *